US009908033B2

(12) United States Patent
Saddler

(10) Patent No.: US 9,908,033 B2
(45) Date of Patent: Mar. 6, 2018

(54) GAME AND METHOD OF PLAYING THE GAME

(71) Applicant: Mattel, Inc., El Segundo, CA (US)

(72) Inventor: Damon R. Saddler, Inglewood, CA (US)

(73) Assignee: Mattel, Inc., El Segundo, CA (US)

( * ) Notice: Subject to any disclaimer, the term of this patent is extended or adjusted under 35 U.S.C. 154(b) by 702 days.

(21) Appl. No.: 13/862,185

(22) Filed: Apr. 12, 2013

(65) Prior Publication Data

US 2013/0270770 A1 Oct. 17, 2013

Related U.S. Application Data

(60) Provisional application No. 61/623,883, filed on Apr. 13, 2012.

(51) Int. Cl.

| | |
|---|---|
| ***A63F 1/00*** | (2006.01) |
| ***A63F 1/18*** | (2006.01) |
| *A63F 1/06* | (2006.01) |
| *A63F 3/00* | (2006.01) |

(52) U.S. Cl.

CPC ..... *A63F 1/00* (2013.01); *A63F 1/18* (2013.01); *A63F 1/062* (2013.01); *A63F 2003/00842* (2013.01)

(58) Field of Classification Search

CPC ..... G07F 17/3293
USPC ..... 273/292; 463/13
See application file for complete search history.

(56) References Cited

U.S. PATENT DOCUMENTS

| | | | | |
|---|---|---|---|---|
| 3,159,403 | A | 12/1964 | Glass et al. | |
| 3,441,280 | A | 4/1969 | Eggermont | |
| 3,484,105 | A | 12/1969 | Winston | |
| 3,582,075 | A | 6/1971 | Glass et al. | |
| 3,841,628 | A | 10/1974 | Goldfarb | |
| 3,953,027 | A | 4/1976 | Katzman et al. | |
| 3,980,298 | A | 9/1976 | Breslow | |
| 5,141,235 | A | 8/1992 | Hernandez | |
| 5,366,227 | A | 11/1994 | Duffy | |
| 5,465,975 | A | 11/1995 | Shull et al. | |
| 6,053,498 | A | 4/2000 | Waychoff | |
| 6,290,230 | B1 | 9/2001 | Anthony | |
| 6,296,253 | B1 | 10/2001 | Waychoff | |
| 6,412,779 | B1 | 7/2002 | Kenney | |
| 6,609,715 | B2 | 8/2003 | Anthony | |
| 7,021,627 | B2 | 4/2006 | Sargent et al. | |
| 7,029,281 | B1 | 4/2006 | Rathyen | |
| 7,219,894 | B2 | 5/2007 | Stewart et al. | |
| 7,318,588 | B1 | 1/2008 | Miller | |
| 8,070,162 | B1 * | 12/2011 | Butcher | 273/292 |
| 2004/0113362 | A1 | 6/2004 | Hardwicke et al. | |
| 2007/0007726 | A1 | 1/2007 | Alessio | |

(Continued)

*Primary Examiner* — Michael Dennis
(74) *Attorney, Agent, or Firm* — Kolisch Hartwell, P.C.

(57) ABSTRACT

A game having: a plurality of game pieces; a plurality of game cards, the plurality of game cards having a plurality of first cards, a plurality of second cards and a plurality of third cards, the plurality of first cards when played require an action to be performed and the plurality of second cards when played allow for one of the plurality of pieces to be possessed; and wherein when each one of the game pieces when possessed provides immunity to the action to be performed when one of the plurality of second cards is played.

19 Claims, 5 Drawing Sheets

(56) References Cited

U.S. PATENT DOCUMENTS

| | | | | |
|---|---|---|---|---|
| 2009/0121427 | A1* | 5/2009 | Berkowitz et al. | 273/146 |
| 2010/0171267 | A1 | 7/2010 | Walker | |

* cited by examiner

GAME AND METHOD OF PLAYING THE GAME

CROSS REFERENCE TO RELATED APPLICATIONS

This application claims the benefit of U.S. Provisional Patent Application No. 61/623,883 filed Apr. 13, 2012, the entire contents of which are incorporated herein by reference thereto.

BACKGROUND

Card games are known to provide fun and entertainment to players of all ages. Players may also enjoy the experience of a card game played in a manner that requires additional interaction with the game as well as with other players. Accordingly, it is desirable to provide a game providing both enjoyment and such interaction.

SUMMARY OF THE INVENTION

In one embodiment, a game is provided, the game having: a plurality of game pieces; a plurality of game cards, the plurality of game cards having a plurality of first cards, a plurality of second cards and a plurality of third cards, the plurality of first cards when played require an action to be performed and the plurality of second cards when played allow for one of the plurality of pieces to be possessed; and wherein when each one of the game pieces when possessed provides immunity to the action to be performed when one of the plurality of second cards is played.

In another embodiment, a method of playing a card game is provided, the method comprising the steps of: dealing a predetermined amount of cards to each player from a deck of cards having a plurality of first cards, a plurality of second cards and a plurality of third cards; taking turns discarding the predetermined amount of cards according a set of rules by matching one of the predetermined amount of cards to a top card of a discard pile, wherein the discarded card becomes the top card; obtaining one of a plurality of game pieces by discarding one of the plurality of second cards onto the top card of the discard pile, wherein an obtained game piece provides immunity from an action to be performed when one of the first set of cards is discarded; and determining a winner of the game when one player discards all of their cards.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
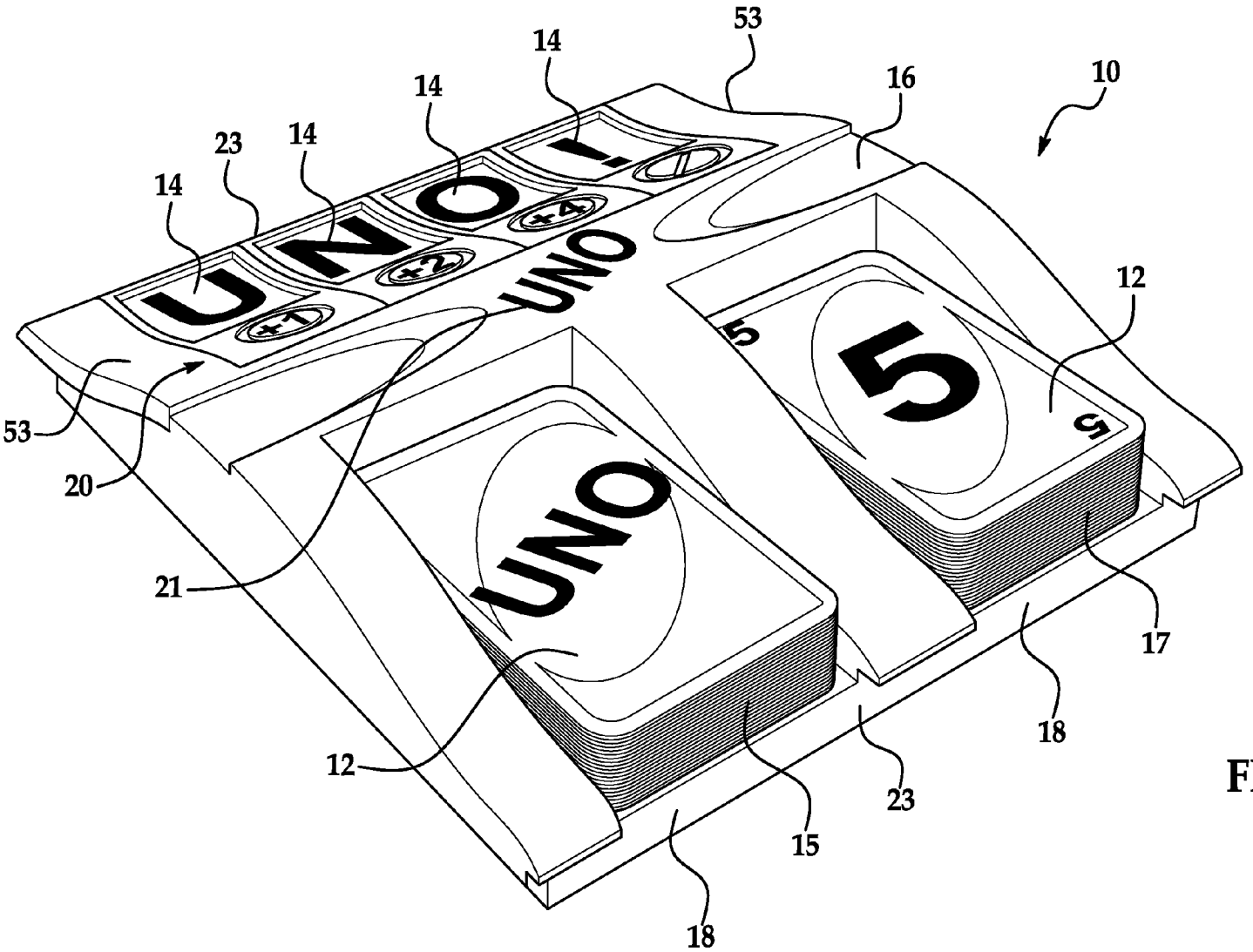
FIGS. 1-3A illustrate a game embodying a non-limiting embodiment of the present invention.

Referring to FIGS. 1-4, a game 10 and a method of playing the game 10 is provided. The game 10 has a plurality of cards or game cards 12, a plurality of game pieces 14 and an apparatus 16 for use with the game cards 12 and game pieces 14 is shown. In one embodiment, the apparatus 16 is configured as a card support structure that is configured to hold and/or support one or more stacks or piles of cards in card receiving receptacles 18. Additionally, the card support structure can also have a receiving area 20 for the game pieces 14.

In one non-limiting embodiment, the game pieces 14 are configured to have enlarged bottom portions 51 in order to provide a wide base or platform so that the game pieces 14 can be vertically arranged on a playing surface 11.

In one embodiment, the apparatus or structure 16 is configured to hold and/or retain one or more stacks or piles of cards 12 in order to provide a draw pile 15 and a discard pile 17. In one non-limiting embodiment, the apparatus or structure 16 has a raised central section 21 that is higher than side portions 23 of the apparatus or structure 16. In addition and in one embodiment, the raised central section 21 is of a sufficient height so that the bottom portions 51 of the game pieces 14 are capable of being stowed within the receiving area 20. In addition and in yet another implementation, the bottom portions 51 of the game pieces 14 may be configured to have a curved front surface 55 complementary to sidewall portions 53 of the apparatus or structure 16 so that when the game pieces 14 are inserted into the receiving area 20 a uniform surface is provided. Moreover, an opposite curved surface 57 of the game pieces is configured to engage a complimentary curved surface 59 and optionally a ledge or feature 61 of the structure 16.

Figure 2:
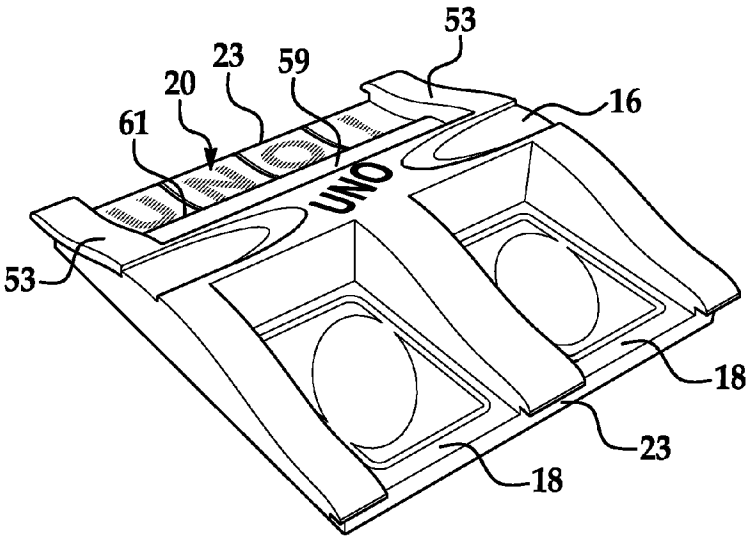
Figure 2:
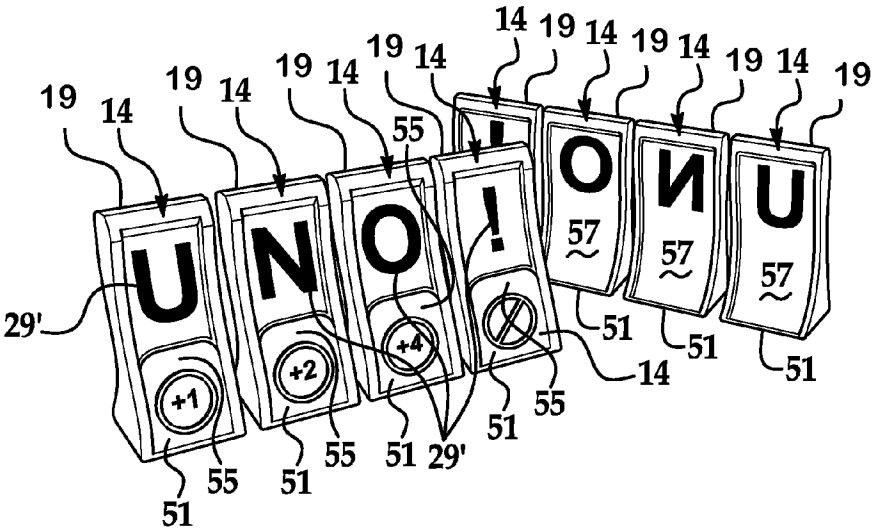

In addition and as illustrated in at least FIG. 2, an upper portion 19 of the game pieces 16 is configured to have a smaller width than the bottom portions 51. This configuration will allow for the game pieces 16 to be arranged vertically on the surface 11, as well as allowing the upper portion 19 to be easily grasped by a player of the game.

At least some of the playing cards 12 may include one or more card indicia. The card indicia may include any suitable type of indicia configured to correspond to and/or match indicia on other playing cards and/or to signify particular supplemental actions that one or more players may and/or must take. The indicia may be in any suitable form, such as numeric, text, alphanumeric, symbolic, color, and/or any suitable combination, configured to correspond to indicia on other playing cards. For example, the card indicia may include numeric indicia 24, symbolic indicia 26, and color indicia 28 and supplemental indicia 29, as illustrated in at least FIG. 3.

Numeric indicia 24 may include any suitable numbers, such as 0-9, and may be on any suitable location(s) on playing cards 12. Although numeric indicia 24 is shown to include single digit numbers, the numeric indicia may additionally, or alternatively, include multiple digit numbers.

Figure 3:
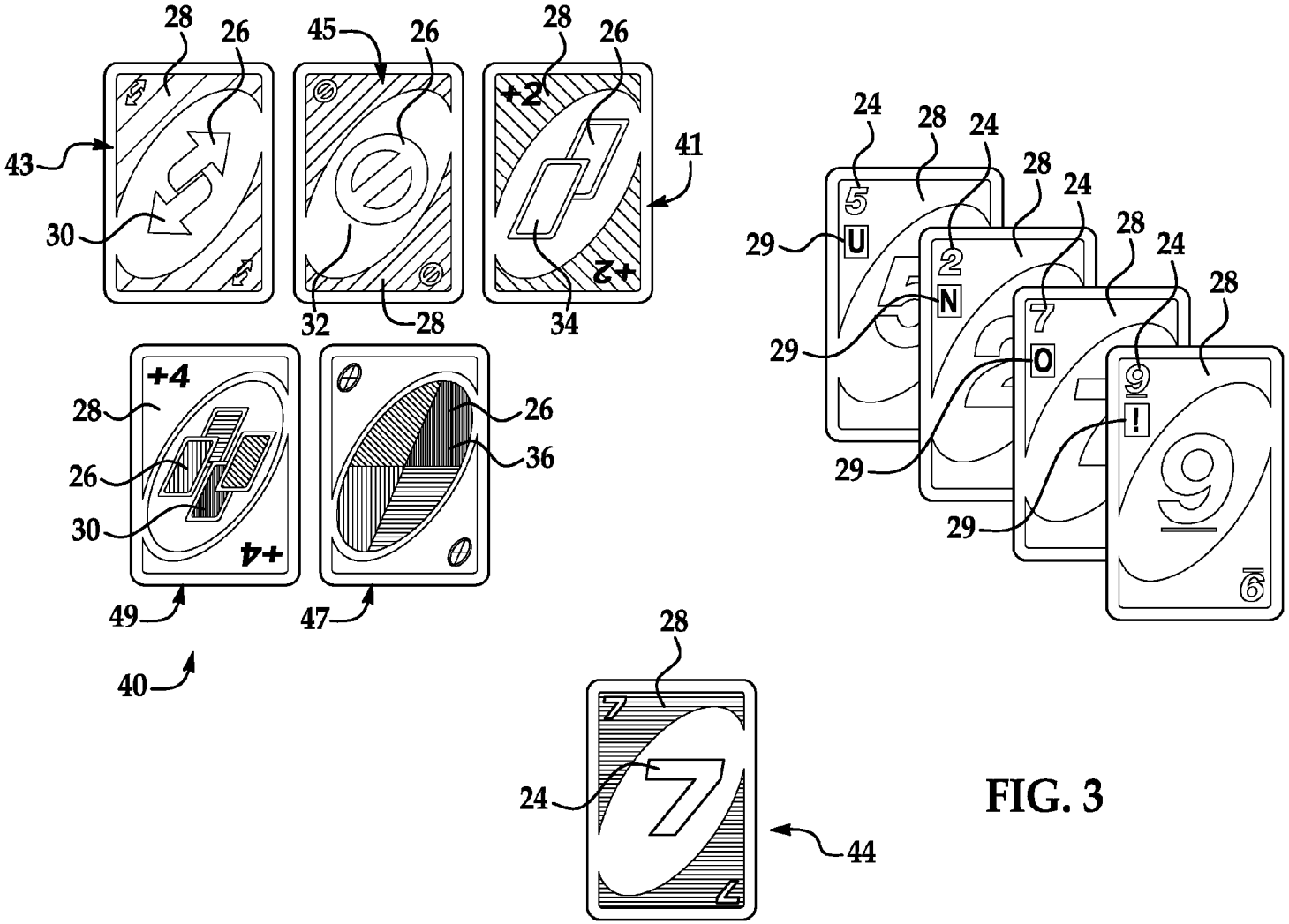

Symbolic indicia 26 may include any suitable symbol(s) on any suitable location(s) on playing cards 12. For example, symbolic indicia 26 may include one or more reverse indicia 30 that may require reversing direction of play, one or more skip indicia 32 that may require one or more players to skip one or more turns, one or more draw indicia 34 that may require one or more players to draw one or more cards, and/or one or more wild card indicia 36 that may be played as if it contained some or all of the numeric indicia and/or color indicia on the playing cards, as shown in FIG. 3.

The color indicia 28 may include any suitable color(s) on any suitable location(s) on playing cards 12. For example, color indicia 28 may include one or more blue indicia, one or more red indicia, one or more green indicia, one or more yellow indicia, and/or any other suitable color(s).

The supplemental indicia 29 may be representative of one or more supplemental actions that one or more players is/are allowed to perform. In one embodiment the supplemental action is the grabbing of one of the game pieces or towers 14. The player that obtains the game piece or tower 14 is now immune to one of the actions required to be performed against a player when one of the cards having symbolic indicia 26 is played against them.

The plurality of cards 12 are further defined into a plurality of first cards or action cards 40, a plurality of second cards 42 and a plurality of third cards 44. The plurality of first cards or action cards 40 may include, Draw Cards 41, Reverse Cards 43, Skip Cards 45, Wild Cards 47 and Wild Draw Four Cards 49. The functions of the first cards or action cards is as follows: 1) Draw Card, when this card is played, the next person to play must draw one, two, four or any other number of cards and miss their turn. This card can only be played on matching colors and other Draw cards. If turned up at the beginning of play, the same rule applies; 2) Reverse Card, when this card is played the direction of play is reversed. Play changes direction to the right, and vice versa. The card may only be played on a matching color or on another Reverse Card. If this card is turned up at the beginning of play, the dealer goes first, and then play moves to the right instead of the left; 3) Skip Card, when this card is played the next player in turn after this card has been played loses their turn and is "skipped". The card may only be played on a matching color or on another Skip card. If a Skip card is turned up at the beginning of play, the player to the left of the dealer is "skipped", hence the player to the left of that player commences play; 4) Wild Card, when this card is played the person playing this card calls for any color to continue the play, including the one currently being played, if so desired. A Wild Card can be played at any time even if the player has another playable card in their hand. If a Wild card is turned up at the beginning of play, the person to the left of the dealer determines the color, which continues play; and 5) Wild Draw Four Card, when this card is played this card allows you to call the next color played and requires the next player to draw four cards from the draw pile and forfeit their turn. If turned up at the beginning of play, return this card to the deck and pick another card. In one embodiment, this card may only be played when the player holding it does not have a card in their hand that matches the color on the discard pile. If the player holds matching numbers or action cards, however, this card may be played.

The plurality of third cards 44 contain numerical indicia 24 and color indicia 28. The plurality of first cards 40 and the plurality of third cards 44 are similar to those used in the card game UNO or other types of shedding card games however, the new plurality of second cards 42 add a feature previously not used. When played, the plurality of second cards 42 allow the players to grab one of the game pieces 14. Once obtained the game pieces 14 protect the possessing player against the sabotage or undesired effect of the Draw cards and the Skip cards. Moreover and in one embodiment, should one player obtain all the game pieces they are allowed to discard all of their cards expect for one, which allows that player to be only one move away from winning the game.

Each of the plurality of second game cards 42 has supplemental indicia 29, which corresponds to matching indicia 29' of one of a plurality of game pieces 14. In one embodiment, there are four game pieces 14. Numbers of game pieces greater or less than four are considered to be within exemplary embodiments of the present invention. In one embodiment, each of the game pieces 14 are three-dimensional objects configured to be easily grasped by a players hand and are configured to be vertically arranged on a surface 11.

In one embodiment, the supplemental indicia 29 and supplemental indicia 29' comprise anyone of a "U", "N", "O", "!". Of course, any other configurations are contemplated to be within the scope of various embodiments of the present invention. When one of the second plurality of cards 42 with the "U" is played that player is allowed to grab and be in possession of the game piece 14 with the matching indicia 29'. This game piece protects the player who possesses it against any Draw One card that is played on them. Also shown on the "U" game piece 14 is the indicia +1 in a circle. In other embodiments, the game piece 14 can be formed with or without this indicia. When this occurs they simply play to the color or symbol on the card without the penalty of drawing a card.

When one of the second plurality of cards 42 with the "N" is played that player is allowed to grab and be in possession of the game piece 14 with the matching indicia 29'. This game piece protects the player who possesses it against any Draw Two card that is played on them. Also shown on the "N" game piece 14 is the indicia +2 in a circle. In other embodiments, the game piece 14 can be formed with or without this indicia. When this occurs they simply play to the color or symbol on the card without the penalty of drawing any cards.

When one of the second plurality of cards with the "O" is played that player is allowed to grab and be in possession of the game piece 14 with the matching indicia 29'. Also shown on the "O" game piece 14 is the indicia +4 in a circle. In other embodiments, the game piece 14 can be formed with or without this indicia. This game piece protects the player who possesses it against any Wild Draw Four card that is played on them. When this occurs they simply play to the selected color by the last player without the penalty of drawing any cards.

When one of the second plurality of cards with the "!" is played that player is allowed to grab and be in possession of the game piece 14 with the matching indicia 29'. Also shown on the "!" game piece 14 is the indicia of a slash with in a circle. In other embodiments, the game piece 14 can be formed with or without this indicia. This game piece protects the player who possesses it from any Skip card that is played on them. When this occurs they are allowed to play on the Skip card with any card in their hand that matches the color or symbol.

Generally speaking, when a card labeled with a supplemental indicia 29 is put into play by a player, that player obtains possession of the game piece 14 with a matching indicia 29'. The player also receives immunity from the actions from the play of a particular subset of the action cards 40 when those actions are directed at the player. Possession of more game pieces 14 imparts immunity to a larger number of subsets of the action cards 40.

As mentioned above, should any one player obtain all of the game pieces 14 they are allowed to discard all of their cards expect for one, which thus allows that player to be only one move away from winning the game. Variations of game play allow players to subsequently take possession of one of the game pieces 14 previously possessed by another player by playing one of the corresponding plurality of second cards 42. Alternatively, once a player possesses a particular game piece 14, that game piece 14 may not be repossessed by another player. In yet another variation, once one player possesses all of the game pieces 14 and they only have one card in their possession, the game pieces 14 are removed from that player back to a neutral location and that player is no longer protected by the game pieces 14.

In one non-limiting embodiment and when a player is down to one last card, they must call out a predetermined phrase such as "UNO" or any other specified words (which may be agreed to before the game). Failure to do so results in that player being penalized by for example drawing two cards from the Draw Pile. Of course, numerous other variations are contemplated to be within the scope of exemplary embodiments of the present invention.

Figure 3A:
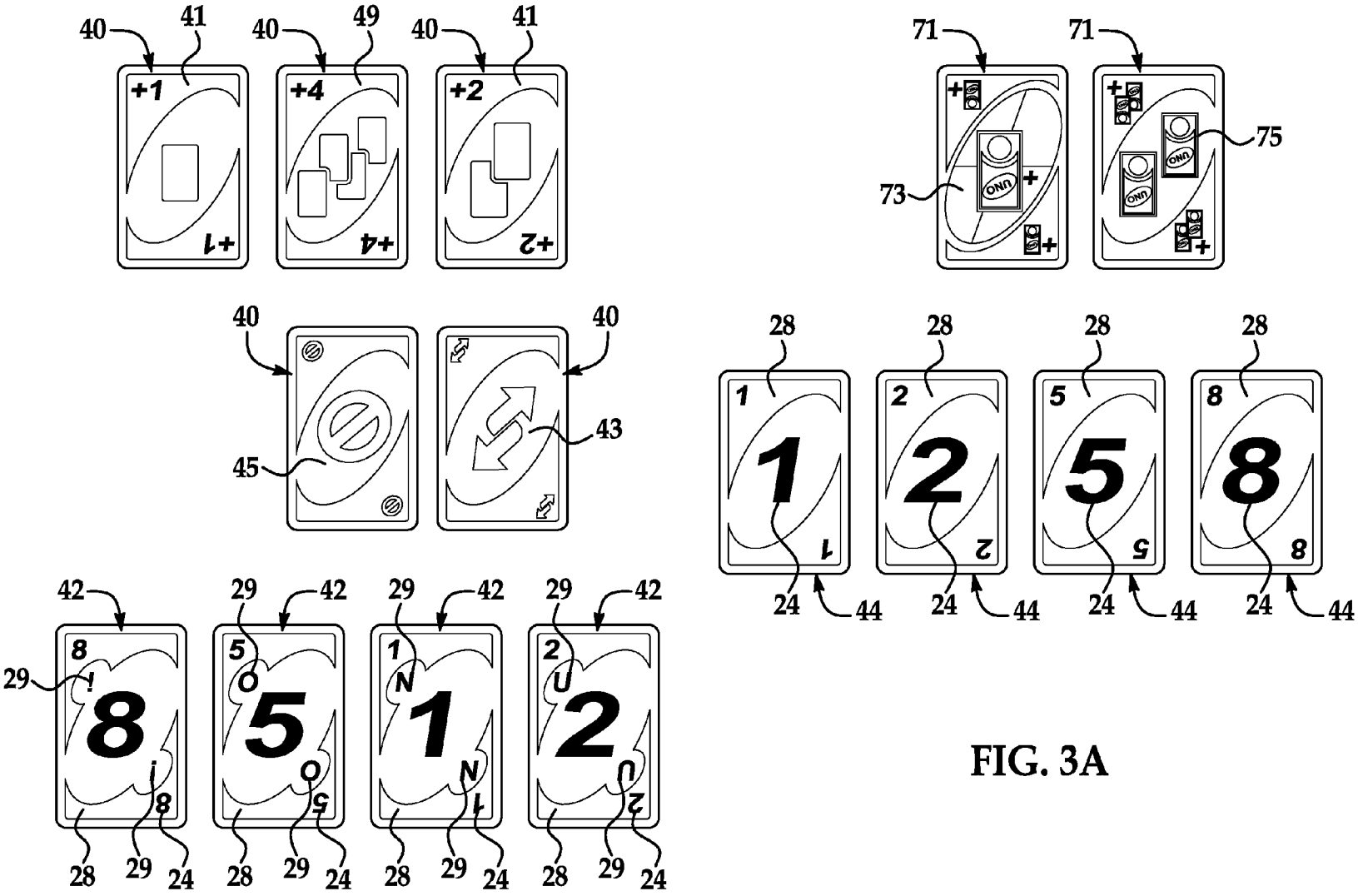

FIG. 3A also illustrates the plurality of first cards or action cards 40, the plurality of second cards 42 and the plurality of third cards 44. Additional optional action cards 71 are also illustrated. Here one of the additional action cards 71 is a "Wild Grab-A-Tower Card" 73 when this card is played, the player playing this card can grab any one tower or game piece 14 of their choosing from either another player or the structure 16. In one embodiment, this card is also a wildcard which allows the user playing this card to choose the color or indicia for continued play, including any color that was previously played before this card. In one embodiment and if this card is turned up by a dealer at the beginning of the game, the first player does not get to grab a game piece 14, but merely is allowed to choose the color or indicia for the next card to be played by the next player.

Another one of the additional actions cards 71 is a "Grab-2-Towers" card 75. When this card is played by a player of the game. The individual played this card can grab any to towers or game pieces 14, this player may take the game pieces from another player or from the structure 16 or combination of two. In one embodiment, this card can only be played if it matches the color or indicia of the previously played card or another previous played action cards 75 (e.g., Grab-2-Towers card). If this card is turned up by the dealer at the beginning of gameplay, the first player does not get to grab two game pieces or towers 14 and is simply required to match the color or indicia of this card.

Figure 4:
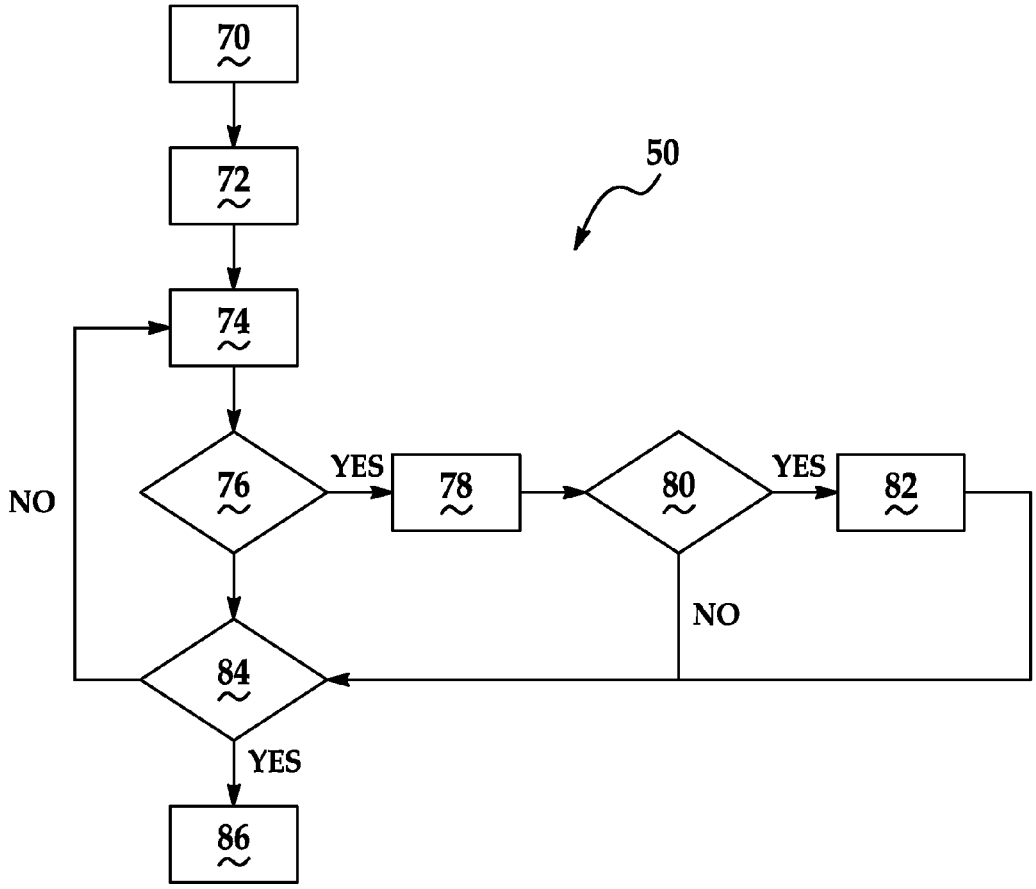
FIG. 4 is a flow chart illustrating a method of playing a game in accordance with an exemplary embodiment of the present invention.

Referring now to FIG. 4, a flow chart 50 depicting one non-limiting exemplary method of playing the game is provided. As mentioned above, the object of the game is to be the first player to discard all of their cards.

At step 70 each player is dealt a predetermined amount of the cards 12 which may contain any one of the plurality of first cards 40, the plurality of second cards 42 and the plurality of third cards 44 to each player.

At step 72 a top card is flipped over from the draw pile 15 to provide the discard pile 17 and the plurality of game pieces 14 are located proximate to the draw pile 17.

At step 74, the players take turns playing cards from their hand to the discard pile 17 according to a set of rules. To play a card, it must match the top card of the discard pile by either color indicia, number indicia or symbolic indicia or any other matching indicia capable of being used in the game. If a player does not have a card that can be played, they must draw one card from the draw pile 15 and add it to their hand.

At decision node 76 if a player plays one of the plurality of second cards 42, with supplemental indicia 29 on it (e.g., U, N, O, or !) they may take the matching game piece with indicia 29' and place it in front of them. This is represented by step 78. As mentioned above, the game piece 14 protects the possessing player from a particular Draw card or Skip card played against them.

If a player is in possession of all the game pieces 14, they are allowed to discard all of their cards expect for one, which allows that player to be only one move away from winning the game. This is represented by decision node 80 and subsequent step 82. As mentioned above and in one embodiment, all of the game pieces of that player are now removed to a neutral location.

The first player to play or discard all their cards wins, which is determined at decision node 84 and step 86.

In accordance with exemplary embodiments of the present invention, the players may take turns going through the method and the goal is to play until any suitable stopping point. For example, the method may be played until one player is able to discard all his or her cards. That player may be the winner. Alternatively, or additionally, the method may be played for a specified time period and/or specified point value to play to. Any suitable scoring may be used to determine the winner, such as basing the scoring, at least in part, on at least some of the indicia of the hand cards of each player. For example, cards may have point values and the player with the lowest or highest score at the end of the time period may win. Alternatively, or additionally, the player that reaches a particular score may win. Although particular stopping points have been discussed, the method includes any and all suitable stopping points.

Additionally, the method may include any suitable preparation steps before beginning the round and/or the game. For example, at least some of the playing cards may be shuffled and a certain number of cards, such as seven cards, may be dealt to each player. Additionally, the cards may be placed in a draw pile and/or a top card of that pile placed in the discard pile. Moreover, an order of play may be determined before the round and/or game. The order of play may be based on any suitable order, such as by descending or ascending age of the players.

Although the method above includes specific sequence and combination of steps, the steps discussed above may be performed in different sequences and in different combinations, not all steps being required for all embodiments of the game. Additionally, although the method includes specific steps, the method may include any suitable steps in addition, or alternative, to the steps discussed above.

In an alternative embodiment, the method may optionally also include the aforementioned action cards 71.

In accordance with various exemplary embodiments of the present invention, the number of game cards 12 may vary depending upon the particular rules of the game. In one non-limiting embodiment, the game cards 12 will have at least one surface which can accommodate the placement thereon of a first identifier and a common identifier. The identifiers are affixed to one side of the card through printing, painting, molding, through the use of an adhesive backed appliqué or any other suitable method for permanently applying the identifiers to the game cards 12 while an opposite side of the card has a non-descript decorative indicia applied thereto such that all of the cards look the same on one side. In one non-limiting exemplary embodiment, the first identifier is a color (e.g., red, blue, yellow, green, or any color) and the second identifier is a number, character, symbol etc. Of course, any type of recognizable indicia or shape may be used as the first identifier and the common identifier.

As mentioned above, the game cards 12 may further comprise a plurality of sub-sets with each sub-set including game cards having at least a first identifier and a common (i.e. to the subset) identifier. Each first identifier in a sub-set is common with at least one other first identifier of another subset. In addition, special game cards, such as the second set of cards 42 are also included in the game with each special game card having a particular use during game play (e.g., involving the acquisition of a game piece 14 during the game).

The game also may include a set of instructions or rules and/or an inventory of contents. Although specific examples have been provided, the game may include a set of any suitable instructions, rules and/or inventory, including any suitable combination of the instructions, rules, and inventory already discussed above.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

The invention claimed is:

1. A game comprising;

a plurality of game pieces;

a plurality of game cards, the plurality of game cards having a plurality of first cards, a plurality of second cards and a plurality of third cards, each of the plurality of first cards having one of a plurality of symbolic indicia, wherein each symbolic indicium represents an action to be performed during play of the game, each of the plurality of third cards comprise one of a plurality of numeric indicia and one of a plurality of color indicia and wherein each of the plurality of second cards comprise one of a plurality of supplemental indicia in addition to at least one of the plurality of numeric indicia and one of the plurality of color indicia; and wherein each one of the game pieces comprises one of a plurality of matching indicia that corresponds to one of the plurality of supplemental indicia located on at least one of the plurality of second cards and wherein each game piece may be possessed during play of the game when one of the plurality of second cards with one of the plurality of supplemental indicia corresponding to one of the plurality of matching indicia of one of the plurality of game pieces is played and when possessed a possessed game piece provides immunity to the action to be performed when one of the plurality of first cards is played with one of the plurality of symbolic indicia that matches the possessed game piece.

2. The game as in claim 1, wherein the plurality of second cards and the plurality of third cards each comprise:

a plurality of sub-sets, the cards in each subset having a common identifier and a first identifier, each first identifier being common with at least one first identifier of another sub-set.

3. The game as in claim 2, wherein the first identifier is one of the plurality of color indicia and the common identifier is one of the plurality of numeric indicia.

4. The game as in claim 3, wherein each of the plurality of game pieces are three dimensional objects.

5. The game as in claim 1, wherein each of the plurality of game pieces are three dimensional objects.

6. The game as in claim 1, further comprising a structure having a receiving area configured to receive each of the plurality of game pieces and a pair of card receiving receptacles configured for receipt of the plurality of game cards therein.

7. The game as in claim 1, wherein at least one of the plurality of game pieces further comprises indicium that matches one of the plurality of symbolic indicia located on at least one of the plurality of first cards.

8. The game as in claim 1, wherein the plurality of symbolic indicia is selected from the group comprising: +1; +2; +4; and Ø.

9. The game as in claim 8, wherein the plurality of supplemental indicia is selected from the group comprising: U; N; O; and !.

10. The game as in claim 1, wherein the plurality of supplemental indicia is selected from the group comprising: U; N; O; and !.

11. The game as in claim 9, wherein each of the plurality of game pieces are three dimensional objects.

12. The game as in claim 9, further comprising a structure having a receiving area configured to receive each of the plurality of game pieces side by side and a pair of card receiving receptacles configured for receipt of the plurality of game cards therein.

13. The game as in claim 12, wherein the structure further comprises a raised central section located between the receiving area and the pair of card receiving receptacles.

14. The game as in claim 13, wherein the raised central section is of a sufficient height so that the bottom portions of the plurality of game pieces are capable of being stowed within the receiving area.

15. The game as in claim 14, wherein each of the plurality of game pieces are configured to have a curved front surface complementary to sidewall portions of the structure such that a uniform surface is provided when the plurality of game pieces are inserted into the receiving area.

16. The game as in claim 15, wherein each of the plurality of game pieces are configured to have an opposite curved surface with respect to the curved front surface and the opposite curved surface is configured to engage a complimentary curved surface of the structure when the plurality of game pieces are inserted into the receiving area.

17. The game as in claim 16, wherein at least one of the plurality of game pieces further comprises indicium that matches one of the plurality of symbolic indicia located on at least one of the plurality of first cards.

18. The game as in claim 8, wherein at least one of the plurality of game pieces further comprises indicium that matches one of the plurality of symbolic indicia located on at least one of the plurality of first cards.

19. The game as in claim 9, wherein each one of the plurality of game pieces further comprises indicium that matches one of the plurality of symbolic indicia located on at least one of the plurality of first cards.

* * * * *